US006918841B2

(12) United States Patent
Chen

(10) Patent No.: US 6,918,841 B2
(45) Date of Patent: Jul. 19, 2005

(54) GOLF CLUB HEAD

(75) Inventor: Chan-Tung Chen, Kaohsiung (TW)

(73) Assignee: Nelson Precision Casting Co., LTD, Kaohsiung (TW)

( * ) Notice: Subject to any disclaimer, the term of this patent is extended or adjusted under 35 U.S.C. 154(b) by 0 days.

(21) Appl. No.: 10/628,442

(22) Filed: Jul. 29, 2003

(65) Prior Publication Data

US 2005/0026718 A1 Feb. 3, 2005

(51) Int. Cl.[7] ..... A63B 53/04
(52) U.S. Cl. ..... 473/342; 473/345
(58) Field of Search ..... 473/342, 345–346

(56) References Cited

U.S. PATENT DOCUMENTS 5,871,408 A * 2/1999 Chen ..... 473/409
6,319,149 B1 * 11/2001 Lee ..... 473/342

FOREIGN PATENT DOCUMENTS

GB 2264872 A * 9/1993

* cited by examiner

*Primary Examiner*—Stephen Blau
(74) *Attorney, Agent, or Firm*—Birch, Stewart, Kolasch & Birch, LLP

(57) ABSTRACT

A golf club head comprises a main body and a striking plate. The main body is provided with an opening formed with a first stepped portion and a second stepped portion. The first stepped portion and the second stepped portion define a groove therebetween. The first stepped portion supports the striking plate with a reduced contact surface area so as to increase the effective elastically deforming area of the striking plate. Further, when the striking plate is combined with the main body by welding, the groove of the main body can obstruct an overflow of melting metal from a welding seam between the main body and the striking plate. Thereby the groove of the main body enhances welding quality and thereby overcomes the problems of club head noises and disturbance caused by flux beads and an inadequate coefficient of restitution caused by insufficient deforming area of the striking plate.

7 Claims, 6 Drawing Sheets

GOLF CLUB HEAD

FIELD OF THE INVENTION

The present invention relates to golf club heads, and more particularly to a golf club head having a groove extended around an inner rim of an opening of a main body for retaining overflow of melting metal in the process of welding the main body with a striking plate.

BACKGROUND OF THE INVENTION

A conventional golf club head comprises a main body 10 and a striking plate 20, as shown in FIGS. 1 and 2. The main body 10 is a wood golf club, which is provided with an opening 11 and a stepped portion 12. The stepped portion 12 is formed around an inner rim of the opening 11 for supporting a lip area around an outer periphery of a inner face of the striking plate 20, so that the main body 10 and the striking plate 20 can be placed together for welding. Referring to FIG. 2, it is a further option that the outer periphery of the striking plate 20 can be bent to form a ring wall 21 so that a striking area of the striking plate 20 is increased.

Applying a welding means to combine the main body 10 and the striking plate 20, the inner rim around the opening 11 of the main body 10 (namely, the welding seam) is constituted a curve that is varied in two-dimensional or three-dimensional space. To weld the main body 10 and the striking plate 20, a welding machine must be preset a welding path in multi-dimensions corresponding to the curve of the main body 10. However, in high-energy welding, a sophisticated welding path may result in a specific decrease in control of welding depth. As a result, the utilization of a relatively high energy welding means for assuring adequate welding depth may easily cause overflow of melting metal (molten metal) intruding into the interior of the main body 10. The intruded melting metal is solidified and attached to an interface between the main body 10 and the inner face of the striking plate 20, which reduces the effective elastically deforming area of the striking plate 20 and therefore the coefficient of restitution, COR, thereof. This also affects the appearance of the main body 10. It is a further disadvantage that the intruded melting metal may fall into the interior of the main body 10 and result in flux beads that cause striking noises and disturbance while wielding a golf club. Moreover, an iron type of the golf club head is usually provided with a cavity at its rear portion. An undercut portion is formed between the cavity and a striking plate. The intruded melting metal will be solidified in the undercut portion and it is difficult to remove. This also affects the coefficient of restitution of the striking plate.

Alternatively, the utilization of a relatively lower energy welding means can avoid the intrusion of overflow of the melting metal, but it may result in an inadequate welding depth that may weaken the entire structure of the golf club head. To prevent melting metal intrusion, a conventional golf club head commonly adopts an enlarged contact area between the striking plate 20 and the stepped portion 12 of the main body 10, which also reduces the effective area of elastic deformation of the striking plate 20. Therefore, it is necessary to improve the structure of conventional golf club heads.

Accordingly, the present invention provides a golf club head whose main body is provided with an inner rim of an opening formed with a first stepped portion and a second stepped portion. The first stepped portion and the second stepped portion define a groove therebetween. When the striking plate is combined with the main body by welding, the groove of the main body can obstruct an overflow of melting metal from a welding seam between the main body and the striking plate. This enhances welding quality and thereby overcomes the problem of club head noises and disturbance caused by flux beads remained the main body. Further, the first stepped portion supports the striking plate with a reduced contact surface area so as to increase the effective elastically deforming area of the striking plate and thereby the striking distance of a golf club.

SUMMARY OF THE INVENTION

The primary objective of the present invention is to provide a golf club head in which a groove is extended around an opening of a main body. The groove is capable of retaining overflow of melting metal occurred in a high-energy welding process, which enhances welding quality and prevents from forming flux beads in the main body to thereby avoid making noises when wielding a golf club.

The secondary objective of the present invention is to provide a golf club head in which a first stepped portion and a groove are extended around an opening of a main body. Since outflow of melting metal is effectively retained within the groove, the first stepping portion is only required to reserve a thin contact area to support the main body. This may effectively increase the long-striking ability of a golf club.

A further objective of the present invention is to provide a golf club head, wherein a first stepped portion and a groove are extended around an opening of a main body. Since outflow of melting metal is effectively retained within the groove, the solidification of melting metal in an undercut portion can be avoided, which improves manufacturing quality of golf clubs.

Accordingly, a golf club head of the present invention comprises a main body and a striking plate. The main body is provided with an opening, around the inner rim of which is formed with a first stepped portion and a second stepped portion. The first stepped portion and the second stepped portion define a groove therebetween. The first stepped portion supports the striking plate with a reduced contact surface area so as to increase the effective elastically deforming area of the striking plate. Further, when the striking plate is combined with the main body by welding, the groove of the main body can obstruct an overflow of melting metal from a welding seam between the main body and the striking plate. Thereby the groove of the main body enhances welding quality and thereby overcomes the problems of club head noises and disturbance caused by flux beads and an inadequate coefficient of restitution caused by insufficient deforming area of the striking plate.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 3:
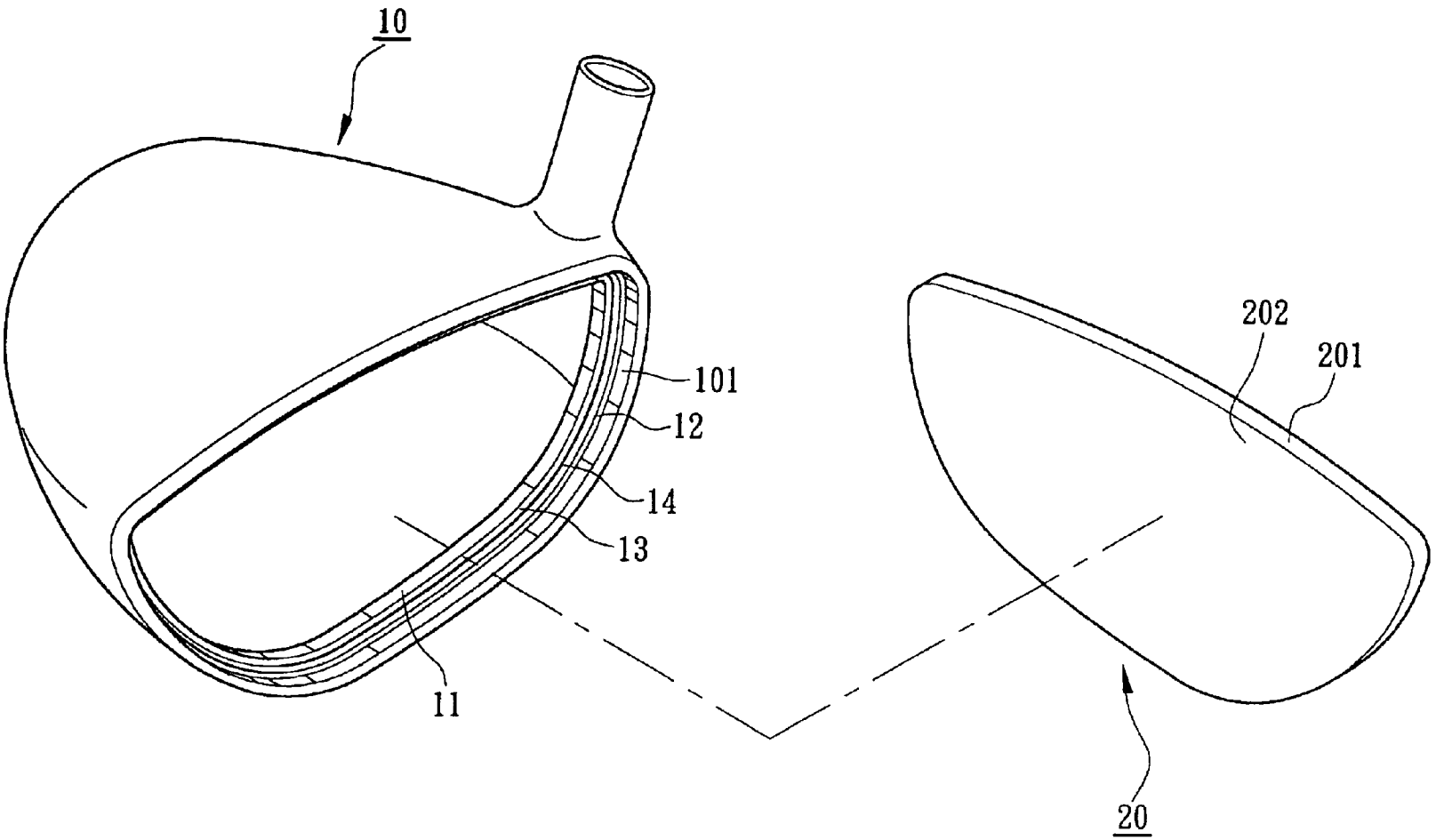
FIG. 3 is an exploded perspective view of a golf club head in accordance with the first preferred embodiment of the present invention.
Figure 4:
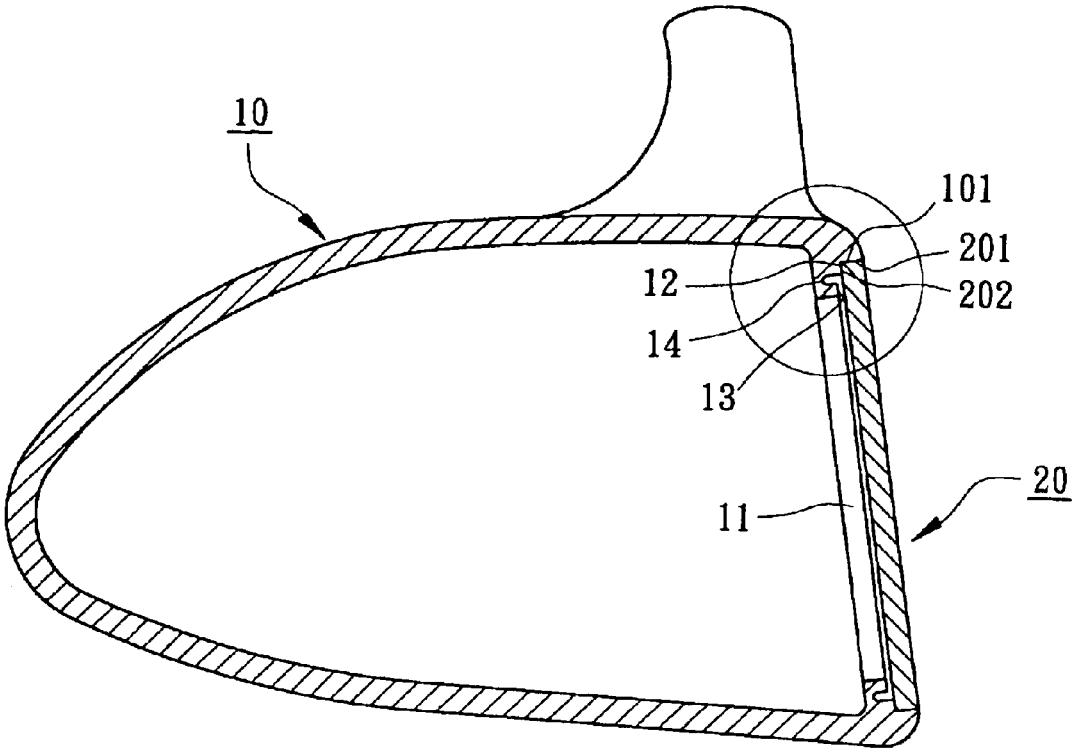
FIG. 4 is a cross-sectional view of the golf club head in accordance with the first preferred embodiment of the present invention.
Figure 5:
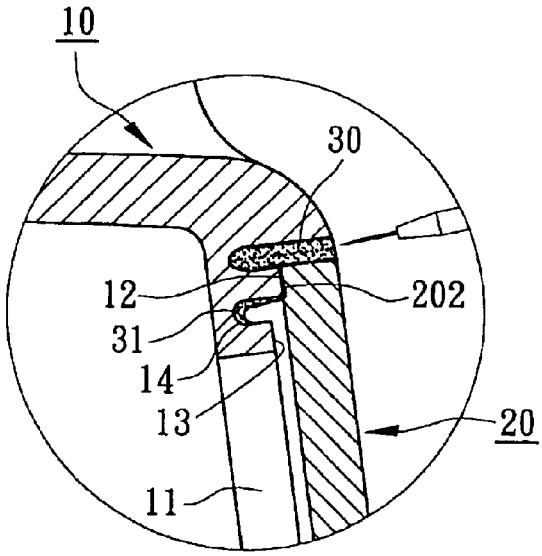
FIG. 5 is an enlarged cross-sectional view of the golf club head in accordance with the first preferred embodiment of the present invention in welding process.
Figure 6:
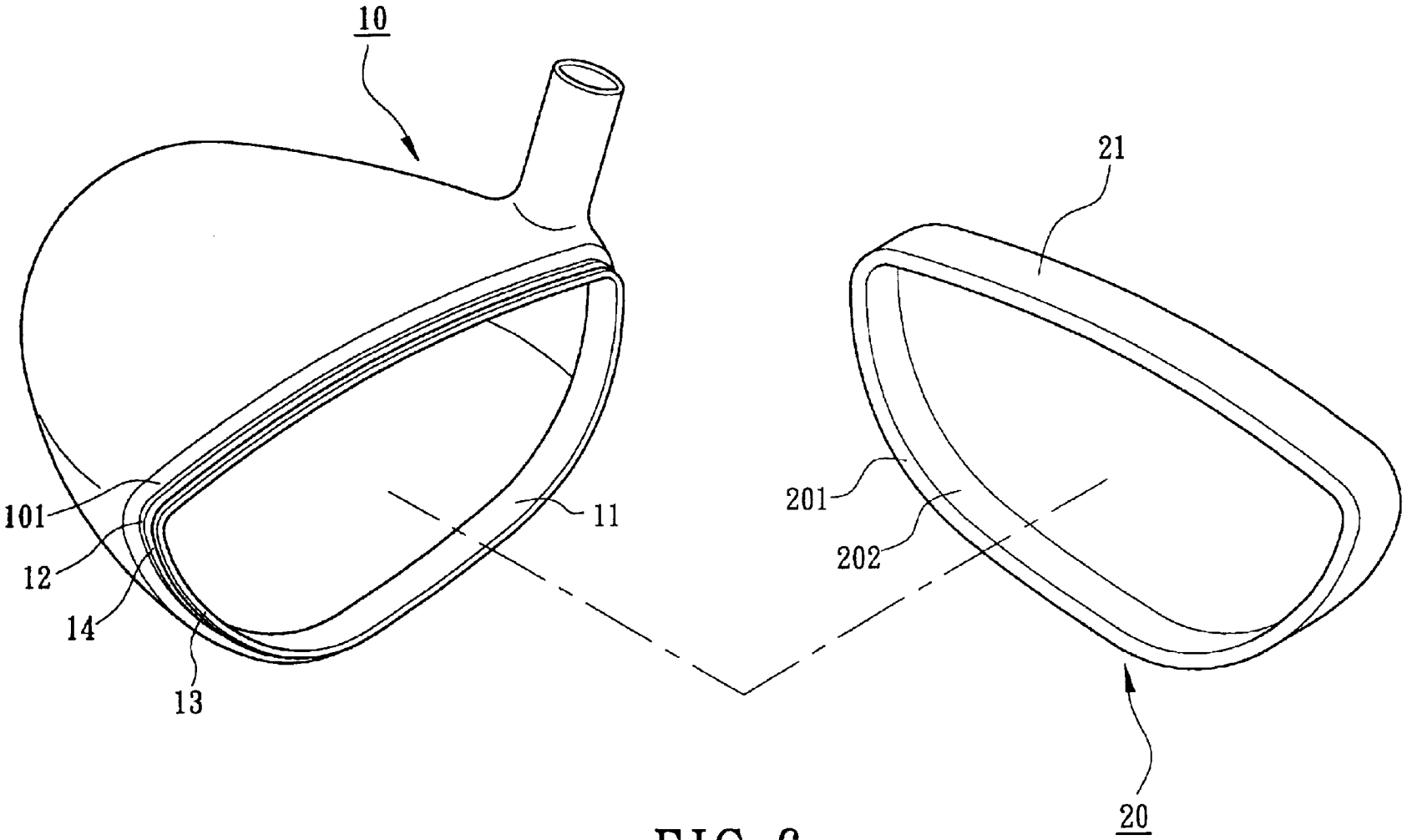
FIG. 6 is an exploded perspective view of a golf club head in accordance with the second preferred embodiment of the present invention.
Figure 7:
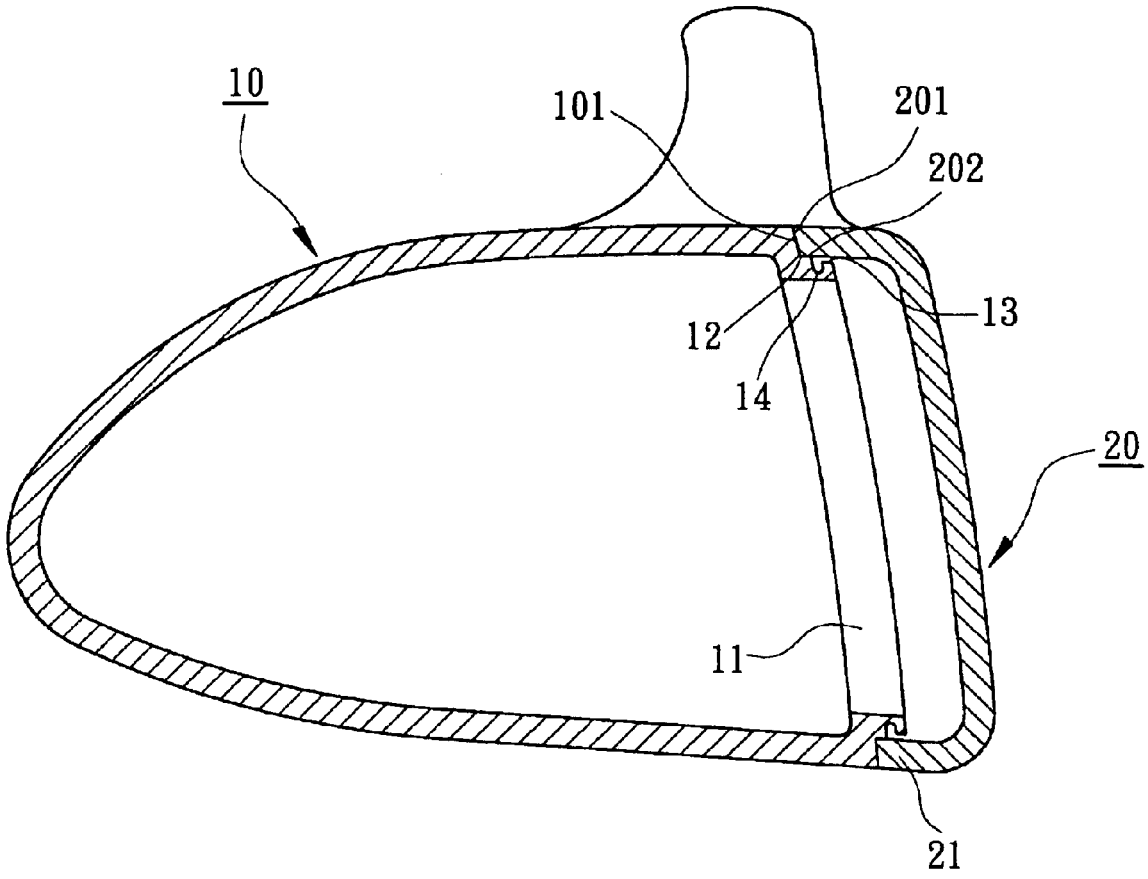
FIG. 7 is a cross-sectional view of the golf club head in accordance with the second preferred embodiment of the present invention.
Figure 8:
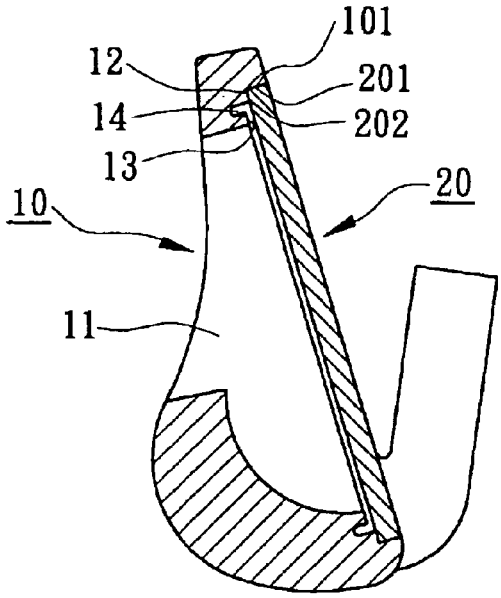
FIG. 8 is a cross-sectional view of a golf club head in accordance with the third preferred embodiment of the present invention.
Figure 9:
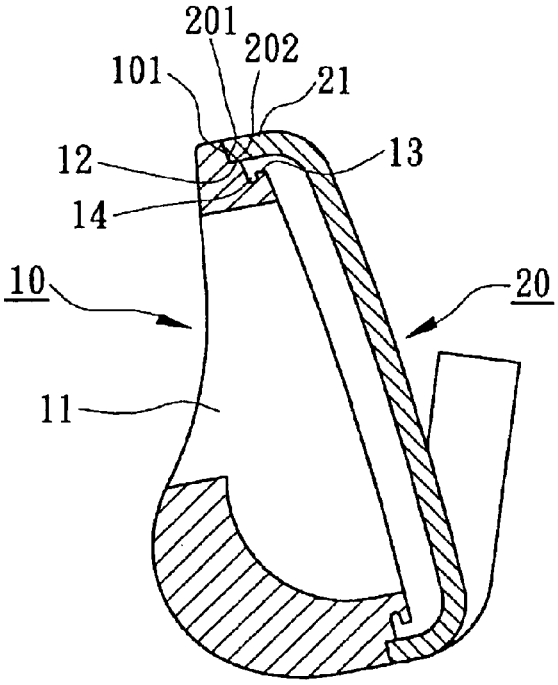
FIG. 9 is a cross-sectional view of a golf club head in accordance with the fourth preferred embodiment of the present invention.
Figure 10:
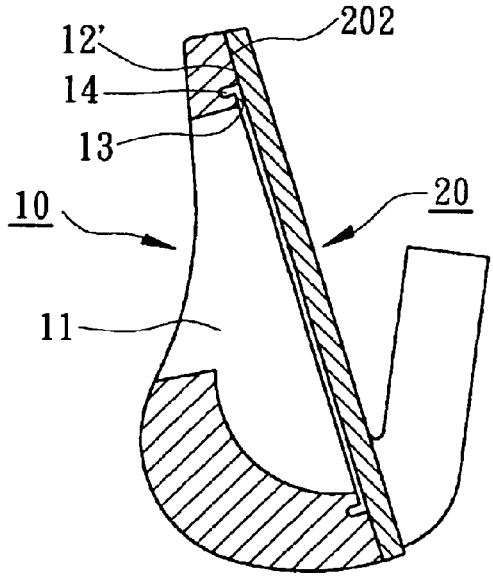
FIG. 10 is a cross-sectional view of a golf club head in accordance with the fifth preferred embodiment of the present invention.

The various objects and advantages of the present invention will be more readily understood from the following detailed description of preferred embodiments when read in conjunction with the appended drawing:

FIG. 3 shows an exploded perspective view of a wood of a golf club head in accordance with the first preferred embodiment of the present invention. FIG. 4 shows a perspective view of the golf club head in accordance with the first preferred embodiment of the present invention in assembled relationship. FIG. 5 shows an enlarged cross-sectional view, FIG. 4, of the golf club head in accordance with the first preferred embodiment of the present invention in welding process. FIG. 6 shows an exploded perspective view of a wood of a golf club head in accordance with the second preferred embodiment of the present invention. FIG. 7 shows a perspective view of the golf club head in accordance with the second preferred embodiment of the present invention. FIG. 8 shows a cross-sectional view of an iron of a golf club head in accordance with the third preferred embodiment of the present invention. FIG. 9 shows a cross-sectional view of a iron of a golf club head in accordance with the fourth preferred embodiment of the present invention. FIG. 10 shows a cross-sectional view of an iron of a golf club head in accordance with the fifth preferred embodiment of the present invention.

Figure 1:
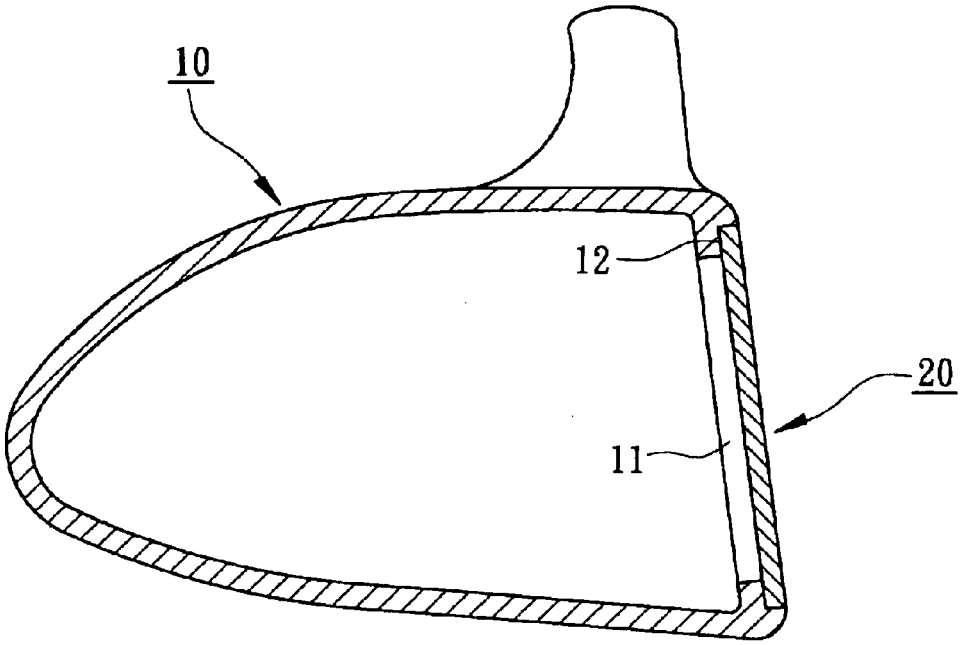
FIG. 1 PRIOR ART
FIG. 1 is a cross-sectional view of a conventional golf club head in accordance with the prior art.
Figure 2:
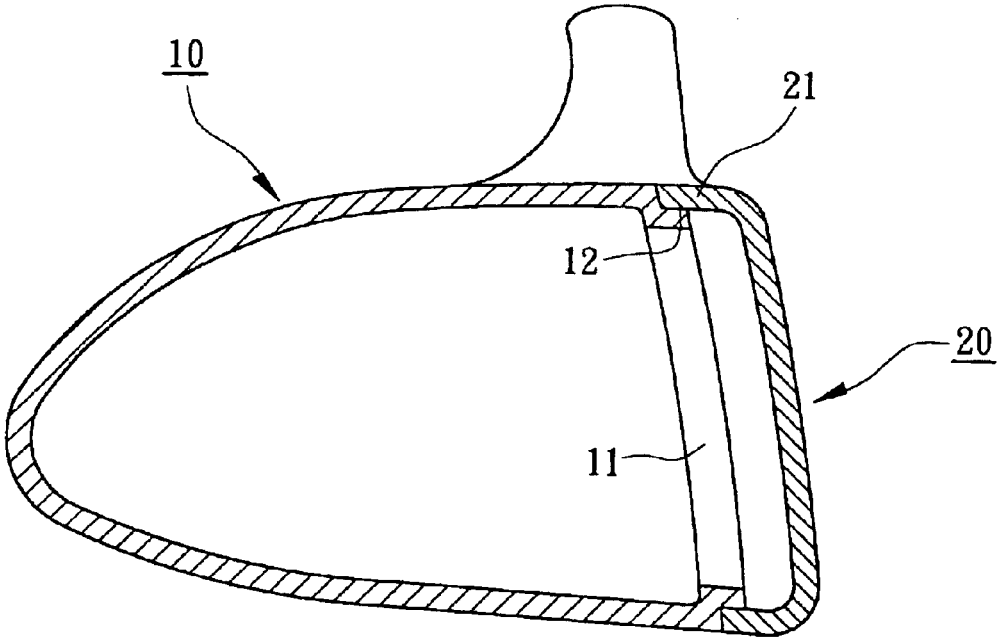
FIG. 2 PRIOR ART
FIG. 2 is a cross-sectional view of an alternative conventional golf club head in accordance with the prior art.

Referring to FIGS. 3 through 5, reference numerals of the first embodiment has applied the identical numerals of the conventional golf club head, as shown in FIGS. 1 and 2. The golf club head of the second embodiment has the similar configuration and same function as that of the conventional golf club head and the detailed descriptions are omitted.

Referring to FIGS. 3 and 4, a golf club head in accordance with the first preferred embodiment of the present invention comprises a main body 10 and a striking plate 20. The main body 10 further includes an opening 11, a first stepped portion 12, a second stepped portion 13 and a groove 14. The main body 10 is a wood type of the club head that is constituted an enclosed body. The opening 11 is located on a front face of the main body 10, which has an inner rim formed with the first stepped portion 12 and the second stepped portion 13. The groove 14 is formed between the first stepped portion 12 and the second stepped portion 13. The striking plate 20 is a metal plate formed with a flat plate or a cambered plate. It is further shaped to fit in the opening 11 of the main body 10, so as to facilitate the subsequent high-energy welding process. More specifically, when embedded in the opening 11, an outer rim 201 of the striking plate 20 is loosely connected with the inner rim 101 of the opening 11. Further, the first stepped portion 12 supports an outer periphery 202 of the striking plate 20 facing the opening 11 of the main body 10 so that the striking plate 20 is spaced a proper distance from the second stepped portion 13.

Referring to FIGS. 4 and 5, the main body 10 and the striking plate 20 are welded together, which uses high-energy welding means selected from laser welding, plasma-arc welding and electron-beam welding. Welding the main body 10 and the striking plate 20 together, the high-energy welding remains a welded seam 30 between the inner rim 101 of the opening 11 of the main body 10 and the outer rim 201 of the striking plate 20. It generally happens that the melting metal 31 may overflow the welded seam 30 into the main body 10 through a space formed between the outer periphery 202 of the striking plate 20 and the first stepped portion 12 of the opening 11. To prevent the intrusion of the melting metal to form beads that causes the noise problem of a conventional golf club head, the present invention utilizes the groove 14 to retain the overflow of the melting metal. It is a further advantage that, since the groove 14 provides accommodation for the intrusion of the melting metal, the first stepped portion 12 only requires a thin welded seam with an adequate area that supports the striking plate 20. Meanwhile, the second stepped portion 13 is allowed to space from the striking plate 20. A reduction of the first stepped portion 12 in contact with the striking plate 20 may result in an increase of deformation of the striking plate 20 that may, thus, extend the striking range of the golf club head.

It is a further measure that an appropriate amount of soldering flux can be applied to the groove 14 before the welding process so as to firmly mount the intrusion of overflow of the melting metal 31 therein.

Referring to FIGS. 6 and 7, it illustrates a golf club head in accordance with the second preferred embodiment of the present invention. In comparison with the first preferred embodiment, the striking plate 20 of the second preferred embodiment includes a bent ring wall 21 integrally formed on an outer rim thereof and erected therefrom. Corresponding to an inner surface of the ring wall 21, an opening 11 of the main body 10 includes an outer rim formed with a first stepped portion 12, a second stepped portion 13 and a groove 14. Identical with the first preferred embodiment, the groove 14 is capable of retaining an intrusion of overflow of the melting metal in the welding process, as shown in FIG. 5. Moreover, the second preferred embodiment utilizes the bent ring wall 21 to thereby enlarge an effective area of elastic deformation of the striking plate 20 in addition to an accommodation of the groove 14 for the intrusion of overflow of the melting metal. Consequently, the enlarged area of the elastic deformation of the striking plate 20 may extend the striking range of the golf club.

Referring to FIG. 8, it illustrates a golf club head in accordance with the third preferred embodiment of the present invention. In comparison with the first and the second preferred embodiments, the main body 10 of the third preferred embodiment is an iron type of the golf club head. A front surface of the main body 10 includes an opening (so-called "cavity") 11, a first stepped portion 12, a second stepped portion 13 and a groove 14. The main body 10 has a rear side opposite to the opening 11, which designed an opening or an enclosed portion. The striking plate 20 is firstly embedded in the opening 11 of the main body 10 and then welded thereto by a high-energy welding means. When the striking plate 20 is embedded in the opening 11, the outer rim 201 around the striking plate 20 connects with the inner rim 101 around the opening 11 of the main body 10. And the first stepped portion 12 of the main body 10 supports the outer periphery 202 around the inner face of the striking plate 20, while the second stepped portion 13 is spaced from the inner face of the striking plate 20 a predetermined distance. In the welding process, the groove 14 effectively retains the intrusion of overflow of the melting metal from the welded seam between the first stepped portion 12 and the striking plate 20, as shown in FIG. 5. The retaining effect of the groove 14 prevents the undercut portion between the opening 11 and the main body 10 from irregular flux beads formed by the intruded melting metal. Therefore, the present invention can omit a cleaning step for flux beads after the welding process that the welding quality is enhanced. In addition, the present invention can avoid the flux beads formed on the striking plate 20 to thereby ensure elastic deformation of the striking plate 20.

Referring to FIG. 9, it illustrates a golf club head in accordance with the fourth preferred embodiment of the present invention. Also, the main body 11 is an iron type of the golf club head. In comparison with the first through third embodiments, the striking plate 20 of the fourth embodiment includes a bent ring wall 21 integrally formed on an outer rim thereof, and erected therefrom. Corresponding to the inner surface of the ring wall 21, an opening 11 of the main body 10 includes an outer rim formed with a first stepped portion 12, a second stepped portion 13 and a groove 14. The groove 14 is capable of retaining an intrusion of overflow of the melting metal in the welding process, as shown in FIG. 5. This prevents the undercut portion between the opening 11 and the main body 10 from irregular flux beads formed by the intruded melting metal so that the welding quality is enhanced. Moreover, the fourth preferred embodiment utilizes the bent ring wall 21 to thereby enlarge an effective area of elastic deformation of the striking plate 20. Consequently, the enlarged area of the elastic deformation of the striking plate 20 may extend the striking range of the golf club. Moreover, the main body 10 has a rear side opposite to the opening 11, which designed an opening or an enclosed portion.

Referring to FIG. 10, it illustrates a golf club head in accordance with the fifth preferred embodiment of the present invention. Also, the main body 11 is an iron type of the golf club head. In comparison with the first through fourth embodiments, a lip area 12' of the fifth embodiment is formed on an outer rim around the opening 11 of the main body 10, which substitutes the first stepped portion 12. Extending inwardly from the opening 11, a groove 14 and a second stepped portion 13 are formed around the inner rim of the opening 11. The striking plate 20 therefore can be attached to the lip area 12' on a front side of the main body 10 for facilitating the subsequent high-energy welding process. The groove 14 effectively retains the intrusion of overflow of the melting metal from the welded seam between the lip area 12' and the striking plate 20, as shown in FIG. 5. This prevents the undercut portion between the opening 11 and the main body 10 from irregular flux beads formed by the intruded melting metal so that the welding quality is enhanced. Moreover, the main body 10 has a rear side opposite to the opening 11, which designed an opening or an enclosed portion.

As disclosed by these preferred embodiments, the present invention indeed overcomes the disadvantages of melting metal intrusion and the reduction of effective elastically deforming area of a striking plate by solidified welding metal. This is simply achieved by introducing a groove 14 within the main body 10 to prevent the intrusion of melting metal 31, which enhances not only welding quality but also striking range of a golf club.

The present invention is thus disclosed by the above-mentioned preferred embodiments, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A golf club head comprising:

a main body including an opening, said opening formed with a first stepped portion, a second stepped portion further inward from said first stepped portion and a groove; and a striking plate adapted to connect with said main body by attaching an outer rim thereof onto said first stepped portion;

said groove is located between said first stepped portion and said second stepped portion;

said groove accommodates and retains melting metal in welding step when said striking plate and said main body are welded together, thereby enhancing welding quality.

2. The golf club head of claim 1, wherein welding said main body and said striking plate are welded together, said second stepped portion is spaced from an inner face of said striking plate a predetermined distance.

3. The golf club head of claim 1, wherein an inner space of said main body is closed.

4. The golf club head of claim 1, wherein an outer periphery of said striking plate is bent to form a vertically extending ring wall for connecting with said main body.

5. The golf club head of claim 1, wherein said striking plate and said main body are welded together by a high-energy welding means.

6. The golf club head of claim 5, wherein said high-energy welding means is selected from a group consisted of laser welding, plasma-arc welding and electron-beam welding.

7. The golf club head of claim 1, wherein said groove is filled with a soldering flux to firmly mount melting metal.

* * * * *